United States Patent [19]

Shank et al.

[11] 4,065,895

[45] Jan. 3, 1978

[54] WOOD BUILDING CONSTRUCTION

[76] Inventors: Richard S. Shank, P.O. Drawer 5603, Charlottesville, Va. 22903; Fred H. Hermanson, Box 38, Charlottesville, Va. 22902

[21] Appl. No.: 699,133

[22] Filed: June 23, 1976

[51] Int. Cl.[2] ..... E04B 1/40

[52] U.S. Cl. ..... 52/210; 52/274; 52/285; 52/289; 52/584

[58] Field of Search ..... 52/90, 92, 93, 127, 52/274, 282, 285, 584, 204, 210, 464, 289, 585

[56] References Cited

U.S. PATENT DOCUMENTS

| | | | |
|---|---|---|---|
| 974,233 | 11/1910 | Brewer | 52/90 |
| 1,261,173 | 4/1918 | Stadelman | 52/92 |
| 1,263,068 | 4/1918 | Kamin | 52/92 |
| 1,375,402 | 4/1921 | McAvoy | 52/90 |
| 1,421,124 | 6/1922 | Brandt | 52/584 X |
| 1,504,454 | 8/1924 | Tyson | 52/92 |
| 2,261,640 | 11/1941 | Bishop | 52/90 |
| 2,378,275 | 6/1945 | Williamson | 52/92 |
| 2,568,133 | 9/1951 | Swisher, Sr. et al. | 52/127 X |
| 2,648,877 | 8/1953 | Vermilya | 52/92 |
| 2,793,245 | 5/1957 | Dunn | 52/584 X |

FOREIGN PATENT DOCUMENTS

| | | | |
|---|---|---|---|
| 865,689 | 3/1941 | France | 52/90 |
| 1,088,967 | 9/1954 | France | 52/584 |

*Primary Examiner*—Alfred C. Perham

*Attorney, Agent, or Firm*—Sughrue, Rothwell, Mion, Zinn and Macpeak

[57] ABSTRACT

The wood building construction is comprised of a panelized wall and/or floor construction which does not require any masonry foundation whatsoever. The vertically extending wall panels are connected to the floor panels in such a manner as to transmit forces acting on the perimeter wall to the floor system and are connected to each other in such a manner as to define a post construction having beam sockets for multiple floor and roof levels. Each vertically extending wall panel for a multi-level construction can extend continuously from the gravel support bed to the roof line to present an unbroken vertical line. The wall panels are constructed and arranged so that each joint is covered by trim and all openings are pretrimmed to allow in situ installation of doors and windows with a minimum of labor.

8 Claims, 14 Drawing Figures

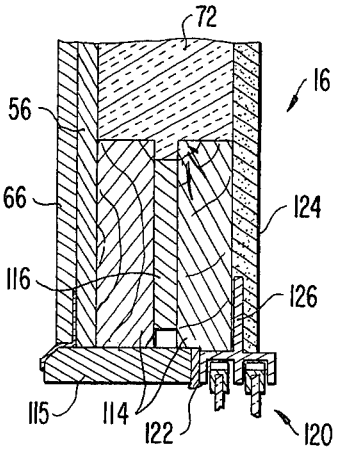
FIG 4
FIG 5
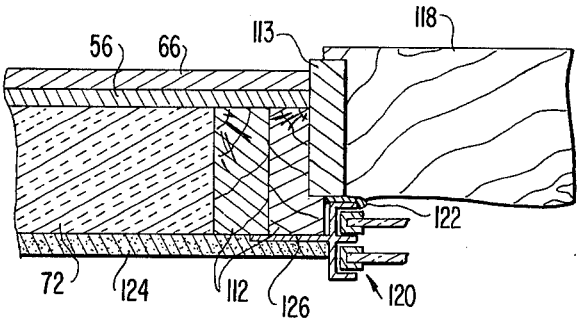
FIG 6
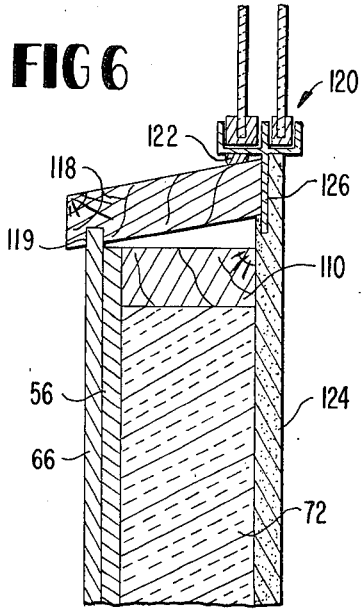
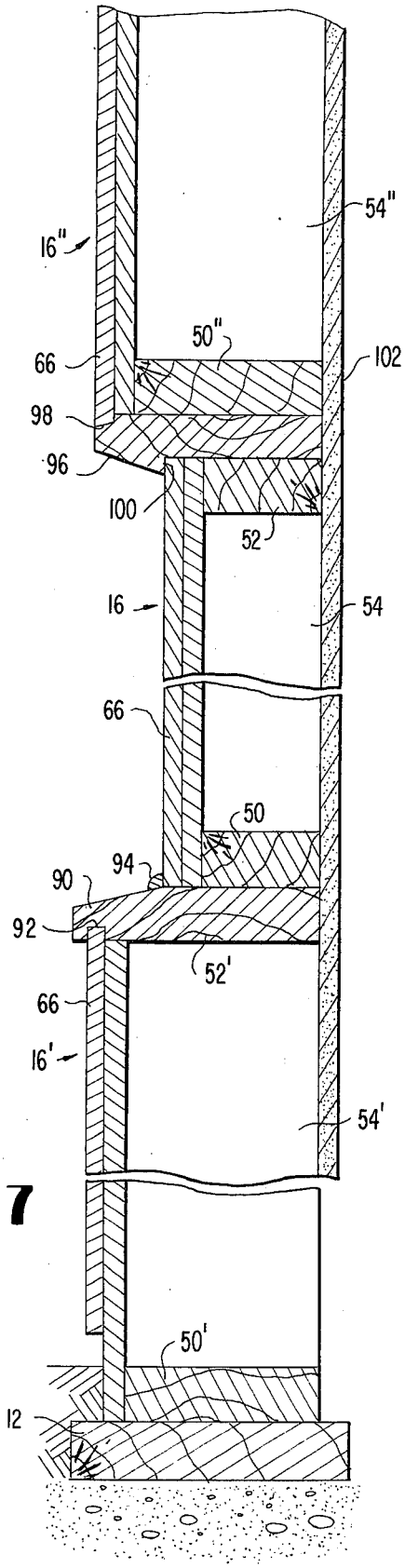
FIG 7

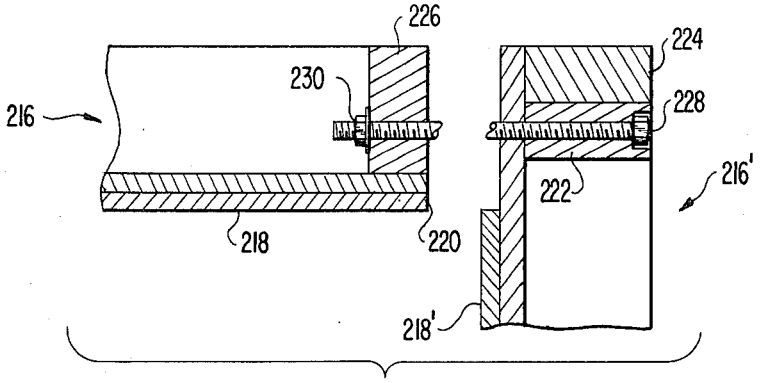
FIG 10
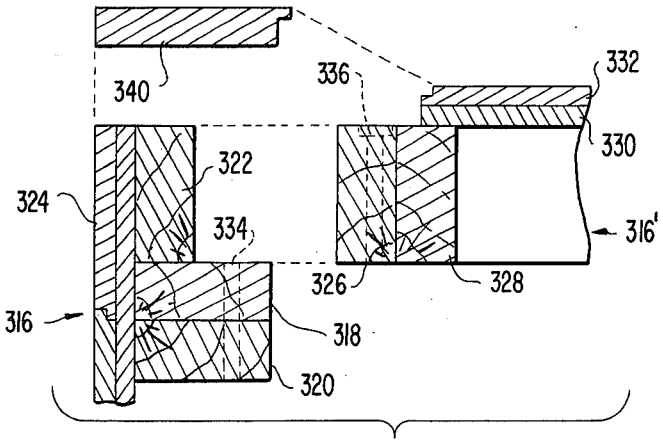
FIG 11
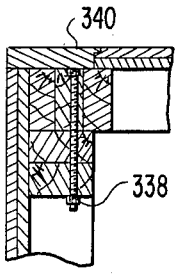
FIG 12
FIG 13
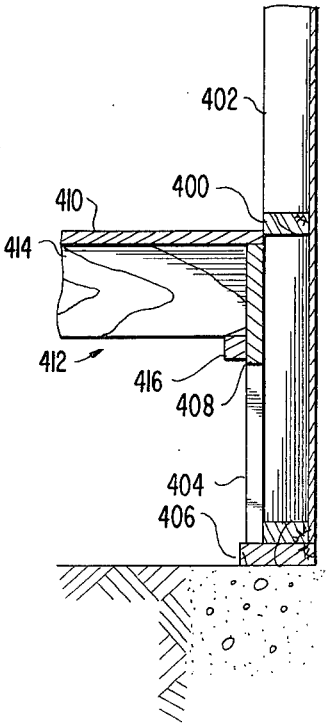
FIG 14
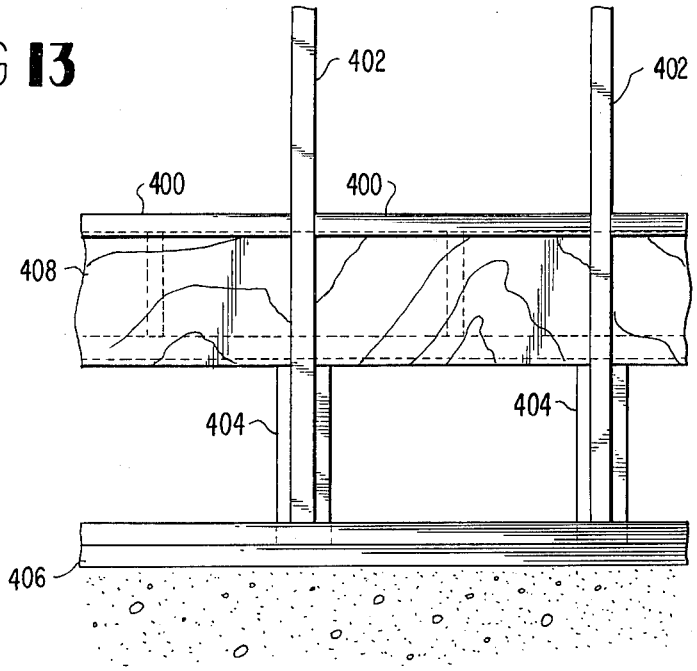

WOOD BUILDING CONSTRUCTION

BACKGROUND OF THE INVENTION

1. Field of the Invention

The present invention is directed to a wood building construction and more specifically to a wood building construction having a panelized floor and multi-level panelized exterior wall construction.

2. Prior Art

With the advent of pretreated lumber it became feasible and acceptable to use wood products below grade in various building constructions. For example, it has been proposed to place a treated wooden floor system directly on sleepers which are either embedded in a concrete floor or rest on a gravel bed. While the foregoing arrangements eliminated the need for a costly crawl space, a separate concrete or masonry type perimeter foundation was still provided about the floor system to support the walls of the structure.

In the art of wood frame buildings the use of balloon framing was prevalent up to the first part of the present century. Panelization or "Western Framing" then came into vogue. However, the panels only extended in height from floor to floor. In a few instances subsequent to the advent of pressure treated lumber the panels would be supported directly on a gravel bed or on a masonry footing and a false wood floor, spaced from the ground would be installed. Once again the use of the crawl space technique added substantially to the construction costs.

SUMMARY OF THE INVENTION

The present invention provides a completely panelized self-supporting wall construction utilizing pressure treated lumber which rests directly on pressure treated wood bearing plates which in turn are supported directly on a gravel bed.

The present invention provides a prefabricated floor system which is set on gravel in panelized form with wood bearing plates for perimeter foundation walls as an integral part of the panelized system.

The present invention also provides a completely panelized curtain wall construction for multi-level buildings wherein the vertically extending wall panels are connected directly to the panelized floor system in such a manner as to transmit the forces acting on the perimeter wall to the floor system.

The present invention provides a panelized wall construction wherein each vertical panel is connected to the adjacent panel in such a manner to form beam support pockets for supporting a plurality of levels. Thus, a multi-level building can be constructed from a plurality of vertically extending prefabricated wooden panels which present a smooth unbroken vertical line and which are provided with an exterior siding which facilitates the complete covering of the panel joint in the field.

The present invention provides a panelized wall construction wherein the window and door apertures in the panel are provided with the exterior trim at the factory in such a manner that window and door units can be installed at the construction site with a minimum amount of time and labor.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 4 is a detail sectional view through the window header in a wall panel according to the present invention.

FIG. 5 is a partial sectional view of a window jamb in a wall panel according to the present construction.

FIG. 6 is a sectional view through a windowsill of a wall panel according to the present invention.

FIG. 7 is a sectional view through a plurality of vertically disposed wall panels showing an offset mode of connection.

FIG. 10 is an exploded sectional view of an inside corner construction.

FIG. 11 is an exploded sectional view of an outside corner construction.

FIG. 12 is an assembled sectional view of an outside corner construction.

FIG. 13 is a sectional elevational view of a floor panel and wall panel connection.

FIG. 14 is a side elevational view of the arrangements shown in FIG. 13.

DETAILED DESCRIPTION OF THE PREFERRED EMBODIMENTS

The wood building according to the present invention is constructed substantially of prefabricated wood panels which constitute the ground floor construction as well as the exterior wall construction. The entire structure can be assembled on the gravel bed 10 without the need for any masonry construction whatsoever. A plurality of footing plates 12, such as 2 inch × 10 inch planks, may be laid directly on the gravel for supporting the wall panels 14 and the edges of the floor panels 16. Depending upon the dimensions of the individual floor panels 16 additional sleepers such as 2 inch × 4 inch or 2 inch × 6 inch boards can be laid directly on the gravel in suitably spaced apart relation to each other and the footing plates 12. If the structure is to be provided with an internal load bearing wall a larger sleeper such as a 2 inch × 8 inch or 2 inch × 10 inch plank can be disposed under the floor panels in alignment with the load bearing wall.

Figure 3:
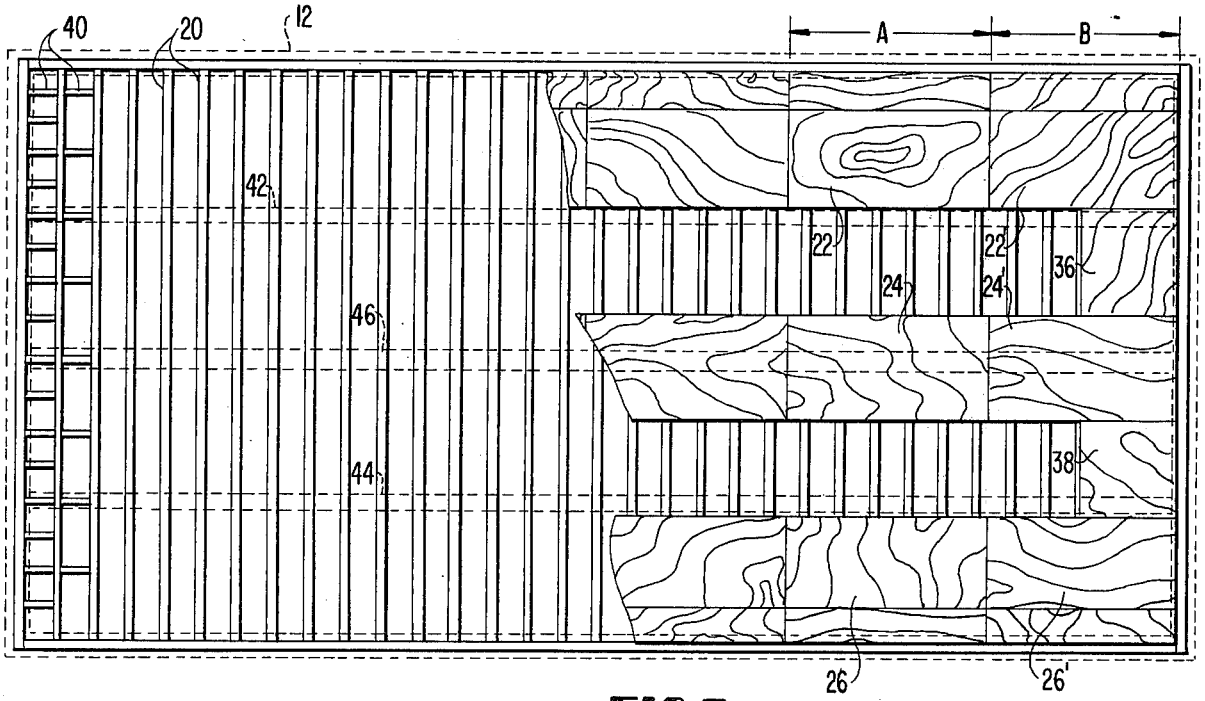
FIG. 3 is a top plan view of an assembled panelized floor construction according to the present invention with portions of the floor covering removed.

By way of example, a complete ground floor construction has been shown in FIG. 3 which would be on the order ot 24 feet × 48 feet. A typical factory assembled floor panel would be 8 feet × 24 feet and would therefore extend across the entire width of the overall floor structure. The floor panel 16 would be comprised of five 2 inch × 4 inch joists 20 located on 16 inch centers from one longitudinal edge with the opposite longitudinal edge being free of a joist. The joists are factory nailed to three 4 feet × 8 feet sheets of plywood 22, 24 and 26 which are spaced from each other by a distance of 4 feet for the reception of field applied 4 feet × 8 feet panels. The ends of the joists terminate inwardly from the outside edges of the plywood panels 22 and 26 by a distance equal to the shorter dimension of a 2 inch × 4 inch edge band 30 which is factory assembled to a wall panel as will be explained in detail hereinafter.

Figure 2:
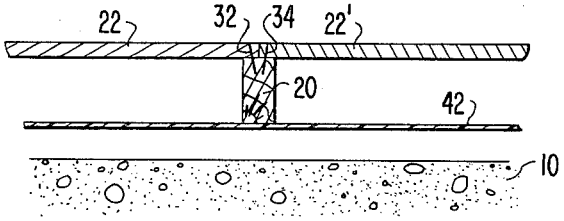
FIG. 2 is a partial sectional view showing the mode of connection between two adjacent floor panels.

Assuming that a floor panel A having partial subflooring consisting of plywood panels 22, 24 and 26 is to be secured to floor panel B having partial subflooring including plywood panels 22', 24' and 26' the two panels would be secured to the other as indicated in FIG. 2. The joists 20 would be factory nailed to the panel 22 by nails 32. At the building site the two prefabricated floor panels A and B would be disposed adjacent each other and the free edge of the plywood panel 22' would be secured to the joist 20 by nails 34. The same would apply with respect to panels 24-24' and 26-26'. The end floor panel B could additionally have 4 feet × 4 feet pieces of half inch plywood subflooring 36 and 38 secured intermediate the 4 feet × 8 feet panels. Thus, when additional 4 feet × 8 feet panels of subflooring are applied at the field site they will span the connecting line between two adjacent prefabricated floor panels A and B and be staggered with respect to the factory applied subflooring. The prefabricated floor sections which will form the ends of a particular building should also be provided with ladder bracing 40 as indicated in FIG. 3 to accommodate the additional strain placed on the joist by the end walls. Finally, each of the prefabricated floor panels would have a factory applied vapor varier consisting of a 6 mil polyethylene sheet 42. For a floor construction having the dimensions of the present example 2 × 4 or 2 × 6 sleepers 42 and 44 would be applied parallel to the longitudinal direction of the building and assuming a load bearing wall would be located down the center of the building structure a 2 × 8 or 2 × 10 sleeper or plate 46 would be provided down the longitudinal axis of the floor structure. These sleepers would rest directly on the gravel bed as do the outer perimeter plates 12. Finally, additional blocking could also be provided between the joists under any load bearing wall.

Figure 1:
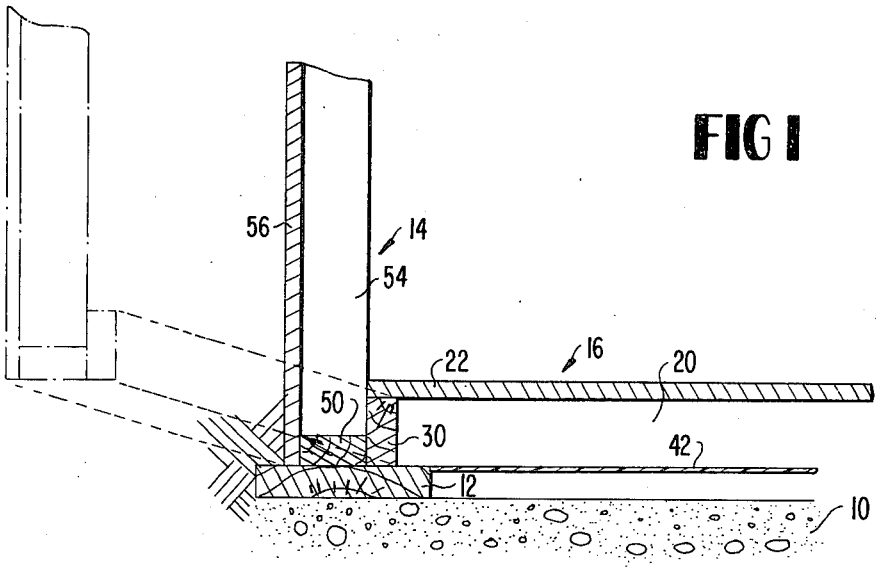
FIG. 1 is a sectional view through a vertical wall panel and a floor panel showing the connection therebetween.

The wall panels 14 according to the present application are prefabricated in any desired length depending upon the number of floor levels desired to the particular building construction. Each wall panel will usually have an 8 foot width and the panel will extend vertically from the perimeter plate 12 all the way up to the roof line to present a smooth unbroken exterior appearance. Each panel is constructed of a 2 × 4 or 2 × 6 base 50, a 2 × 4 or 2 × 6 top header 52 and a plurality of 2 × 4 or 2 × 6 studs 54. The outer face of each prefabricated wall panel 14 is provided with a half inch plywood sheeting 56. As indicated previously a 2 × 4 edge board 30 for the floor panels is factory applied to the base member 50 so that during assembly of a wall panel 14 to a floor panel 16 the wall panel can readily be moved into position from the dotted line position as shown in FIG. 1 to the solid line position with the edge board 30 disposed underneath the plywood decking 22 in abutting engagement with the ends of the floor panel joist 20. The wall panel 14 and the floor panel 16 can then readily be secured together by nails through the plywood decking 22 into the edge band 30 and wall panel 14 can be nailed to the perimeter plate 12 through the base member 50.

Figure 8:
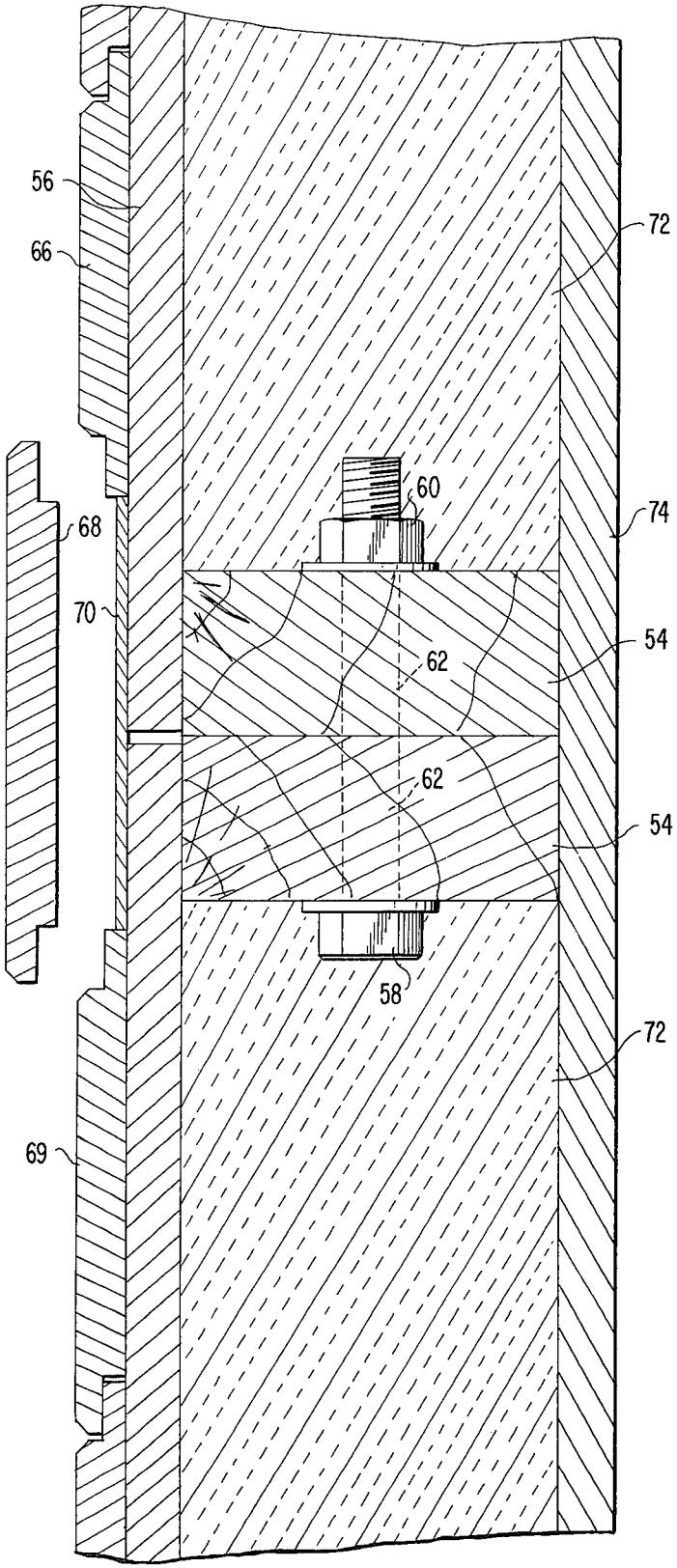
FIG. 8 is a horizontal sectional view through the connecting joint between two adjacent vertically extending wall panels.

In assembling the prefabricated wall panels 14 into a unitary wall construction the vertically extending edge 2 × 4's 54 of each panel are abutted against each other as best seen in FIG. 8 and bolted together at the field site by means of a bolt 58 and nut 60. The bolt 58 can readily be inserted through factory drilled holes 62 in the studs 54. Vertically extending ship-lap siding 66 may be factory applied to the plywood sheeting 56 with the exception of a vertical strip along each vertical edge of the panel 16. A special double lap board 68 is provided for field application to cover the vertical joint between the two panels 16. A moisture barrier of roofing felt, plastic or the like can be applied over the joint prior to the application of the double lap board 68. Each of the panels may be provided with suitable factory installed insulations 72 and internal finishing wall board 74 may be applied at the field site after the panels have been joined together.

Figure 9:
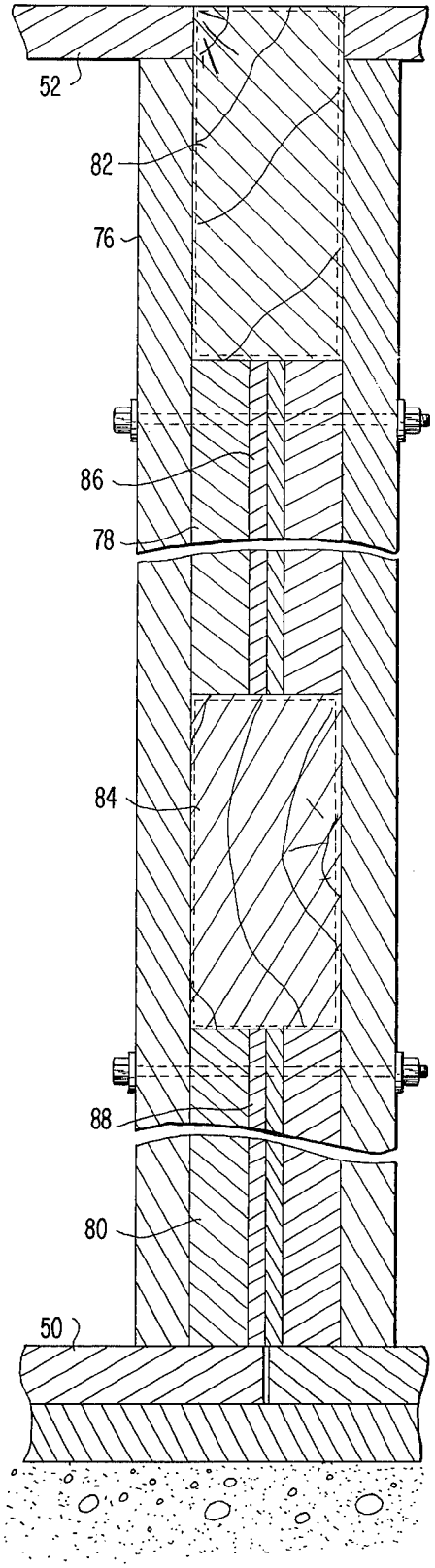
FIG. 9 is a vertical sectional view through the connecting joint between two vertically extending panels wherein two beam pockets are provided for plural floor levels.

For multiple level constructions it is desirable to connect the wall panels 16 in such a manner as to provide beam pockets for the various floor levels including the floor level at the roof line. In order to accomplish this the panels are slightly modified in FIG. 9 from the arrangement shown in FIG. 8 inasmuch as the continuous edge stud 76 is set back from the edge of the panel and blocking comprised of shorter lengths of 2 × 4 studs 78 and 80 are applied to the outer surface of the continuous edge studs 76 in spaced apart relation. In order to support 4 × 10 inch beams 82 and 84 for the various floor levels an additional facing of half inch plywood 86 and 88 is secured to each blocking stud 78 and 80, respectively. Thus, when two similar panels are bolted together as seen in FIG. 9 a beam pocket having the proper dimensions will be provided for each beam 82 and 84, respectively. While the construction shown in FIG. 9 contemplates the provision of a ground floor level (not shown), an intermediate floor level supported by beams 84 and a roof level defined by the beams 82 it is obvious that additional floor levels could be provided depending upon the height of the wall panels 14. For ease of handling the height of the wall panels 14 would generally be limited to approximately 24 feet, the same as the length of the floor panels, so as to provide a structure having two intermediate floor levels.

The panels may be bolted together at a building corner in two different ways depending on whether the corner is an inside corner or an outside corner. In FIG. 10 an inside corner arrangement is shown wherein two conventional wall panels 216 and 216' can be bolted together. The siding 218 along the face of the panel 216 is a modified form of ship-lap siding similar to the siding 66 but with the longitudinal edge 220 formed without a longitudinal groove disposed flush with the edge of the panel 216. A similar siding strip 218' is secured to the panel 216' and spaced from the edge of the panel by a distance equal to the thickness of panel 216 including the ship-lap siding 218. An additional 2 × 4 brace 22 (or 2 × 6 depending on the type of panel involved) is secured flush with the edge stud 224 on the inside thereof. Aligned holes are drilled through the end stud 226 of panel 216 and the brace 222 of panel 216'. A bolt 228 is inserted through the aligned holes and held therein by nut 230 to secure the panels 216 and 216' together with siding 218' abutting and overlapping the end of siding 218.

An outside corner is shown in FIGS. 11 and 12 for joining two panels 316 and 316' together. The double studs 318 and 320 are set inwardly from the edge of the panel 316 by a distance equal the longer dimensions of a third stud 322 secured to the back of the panel 316 flush with the edge. A siding strip 324 similar to siding strip 218 is secured to the face of the panel flush with the edge thereof. The edge of the panel 316' is also double studded with studs 326 and 328 with the edges of the plywood sheet 330 and ship-lap siding 332 being spaced from the edge of the panel. Aligned aperture 334 and 336 are drilled in the end studs of each panel for the reception of a nut and bolt assembly 338 to secure the panels together. After the panels have been bolted together a special ship-lap corner piece 340 having a thickness equal to the combined thickness of the sheeting 330 and siding 332 is nailed in place to cover the joint.

In all of the foregoing panel constructions only a small number of different ship-lap siding pieces are required. In addition to the basic ship-lap siding 69 (FIG. 8) only a limited number of special double lap boards 66 and 68 (FIG. 8) and special corner boards 324 and 340 (FIG. 11) are required thereby simplifying the construction.

In the event a building structure is required having more than two intermediate floor levels it would be advisable to resort to the arrangement shown in FIG. 7. According to this embodiment a standard panel 16 similar to that discussed above is mounted in an offset or stepped manner between two vertically aligned panels 16' and 16" which are similar in construction to the panel 16. While the panel 16 utilizes 2 × 4's for the framing of the panel the panels 16' and 16" utilize 2 × 6's for the framing. The panel 16' is provided with a factory installed sill 90 having a groove 92 for the reception of the vertically disposed ship-lap siding 66. A strip of sealing material 94 may be provided between the panel 16 and the sill 90. The panel 16 may be field nailed to sill 90 through the base member 50. The top panel 16' is provided with a factory installed sill 96 which is provided with a notch adjacent the outer edge thereof for the reception of the lower end of the vertical ship-lap siding 66. The sill is also provided with a cut-out portion 100 for the reception of the top of the panel 16 which is nailed thereto through the header 52. A suitable interior wall finish 102 can be provided. The length of the panels 16, 16' or 16" can vary to encompass one or more stories. Furthermore, any combination of the panels 16, 16' and 16" can be provided to present a different overall exterior appearance. The column of vertically disposed panels could be connected to an adjacent column of vertically disposed panels according to the arrangement shown in FIG. 9 so that the necessary beam sockets would be provided for supporting the various floor and roof levels.

In view of the relatively large size of the factory built wall panels the window and door units are preferably not installed at the factory in order to reduce the weight of the panel being transported. In order to prevent excessive site time for the builder a novel framing arrangement for the windows is shown in FIGS. 4–6 which will allow the quick and easy installation of standard flange mounted aluminum windows. The panel shown in FIGS. 4–6 is the conventional panel disclosed previously having the plywood sheeting 56, vertical ship-lap siding 66 and insulation 72. The window opening is framed by a lower horizontal 2 × 4 plate 110, a pair of vertical 2 × 4's 112 on each side of the opening and a pair of 2 × 4 headers 114 separated by a strip of half-inch plywood 116 to provide the required thickness. Trim pieces 113 and 115 extend into the opening at the sides and top of the opening to a depth which will allow the flush mounting of a window unit 120 against the rough framing and the trim. Flashing 117 is provided over the exposed edge of top trim 115. The sill 118 is also factory installed between the vertical studs 112 beneath the side trim 113 and is provided with a groove 119 for the top of the vertical ship-lap siding 66. A suitable bead of sealing material 122 is provided between the window unit 120 and the sill 118 as well as around the edges of the window unit. After the installation of the prefabricated window unit in the prefabricated wall panel a suitable interior finish 124 can be provided to cover the flange 126 of the window unit.

While the beam pocket arrangement as shown in FIG. 9 is preferred for supporting the various floor levels the modified arrangement shown in FIGS. 13 and 14 is extremely suitable for a single floor structure wherein the floor is to be spaced from the ground. Spacers 400 are secured between the studs 402 of a conventional panel at the desired floor level to strengthen the panel. A cripple 404 is secured to the face of each stud 402 and rests on the plate 406. A 2 × 6 plate 408 is supported on the cripples 404 and is nailed to the studs 402. The plywood decking 410 of the floor panel 412 is then nailed to the top edge of the plate 408 which will act as the edge board for the floor panel similar to the arrangement between the decking 22 and edge board 30 in FIG. 1. Additional support for the joists 414 of the floor panel can be provided in the form of a 2 × 2 brace 416 nailed to the plate 408. By using this interior supplemental floor support system it is possible to use 2 × 4's in the panel construction rather than 2 × 6's which would be needed for a multi-floor level construction.

All of the lumber used in the support plates, floor panels and wall panels within 18" of the ground should be pressure treated to resist insects, moisture and the like. Such a lumber treating method is old and well known and would not form a part of the present invention.

While the invention has been particularly shown and described with reference to preferred embodiments thereof it will be understood by those in the art that the foregoing and other changes in form and details may be made therein without departing from the spirit and scope of the invention.

What is claimed is:

1. A wood building construction comprising a plurality of wood support plates adapted to be placed directly on a gravel support bed, a plurality of prefabricated rectilinear floor panels, each of said floor panels comprising a plurality of parallel spaced apart joists and a plurality of rectilinear deck boards disposed transversely of said joints and secured thereto with one end of each board only partially overlapping an outer one of said joists and the other end of each deck board extending beyond the other outer joist of said joists a distance equal to the spacing between said joists and secured to said outer one of the joists of an adjacent panel, the ends of said joists terminating inwardly from the side edges of said deck boards a distance equal to the width of said joists, a plurality of prefabricated vertically extending rectilinear wall panels mounted on said support plates in abutting relation to said floor panels, each of said wall panels having a plurality of parallel spaced apart studs secured to top and bottom plates, an end plate secured to the bottom plate of each wall panel in abutting relation to the ends of said joists and means securing said side edges of said deck board to said end plates to connect said wall panels and said floor panels together.

2. A wood building construction as set forth in claim 1 further comprising additional wall panels extending parallel to and abutting said joists and a plurality of transversely extending braces secured between adjacent joists along the sides of the floor structure defined by said plurality of floor panels to assist in transferring the forces acting on the wall panels to said floor structure.

3. A wood building construction as set forth in claim 1 wherein said floor panels are provided with vapor barrier means on the side thereof opposite said boards.

4. A wood building construction comprising support plate means adapted to be placed directly on a gravel support bed, a plurality of prefabricated rectilinear wood wall panels, each of said wall panels having a plurality of parallel spaced apart studs secured to top and bottom plates and external wood sheathing secured to said studs, each of said panels having at least one additional beam supporting stud secured to at least one side edge of each panel with the top end thereof being spaced from the top end of the panel by a distance equal to the thickness of a floor beam, means connecting two panels having said additional beam support stud on opposing edge surfaces to define a beam supporting pocket adjacent the top of said panels for a first floor level.

5. A wood building construction as set forth in claim 4 further comprising an additional beam supporting stud secured to the side of each panel in spaced relation to said first mentioned beam supporting stud to define a second beam supporting pocket for a second floor level.

6. A wood building construction as set forth in claim 4 further comprising sill means secured to the top of said prefabricated panels and additional prefabricated panels similar to said first mentioned prefabricated panels but having a different thickness mounted on top of said sill means to provide a stepped wall construction.

7. A wood building construction as set forth in claim 4 further comprising a header plate means and sill means connected between spaced apart studs to define a window opening, exterior trim means secured to said studs and said header plate means within said window opening and exterior siding secured to said sheathing, said exterior trim means extending outwardly beyond said header plate means and said studs a distance sufficient to cover the edges of said sheathing and siding with the inner edges of said trim means being spaced outwardly from the interior surface of said panel to define a peripheral recess for receiving a window unit from the interior.

8. A wood building construction as set forth in claim 4 further comprising vertically disposed ship-lap siding secured to said sheathing in overlapped relations and spaced from the edges of each panel and an additional ship-lap board spanning the joint between and secured to two adjacent panels.

* * * * *